US011535287B2

(12) United States Patent
Escuriola Ettingshausen et al.

(10) Patent No.: US 11,535,287 B2
(45) Date of Patent: Dec. 27, 2022

(54) RAIL SYSTEM AND METHOD FOR OPERATING A RAIL SYSTEM HAVING A RAIL-GUIDED MOBILE PART AND HAVING A CENTRAL CONTROL SYSTEM

(71) Applicant: SEW-EURODRIVE GMBH & CO. KG, Bruchsal (DE)

(72) Inventors: Manuel Escuriola Ettingshausen, Eltville (DE); Björn Grothe, Gutenberg (DE); Daniel Schmidt, Speyer (DE); Stephan Meyer, Mainz (DE)

(73) Assignee: SEW-EURODRIVE GMBH & CO. KG, Bruchsal (DE)

( * ) Notice: Subject to any disclaimer, the term of this patent is extended or adjusted under 35 U.S.C. 154(b) by 332 days.

(21) Appl. No.: 16/648,486

(22) PCT Filed: Aug. 27, 2018

(86) PCT No.: PCT/EP2018/025222
§ 371 (c)(1),
(2) Date: Mar. 18, 2020

(87) PCT Pub. No.: WO2019/052689
PCT Pub. Date: Mar. 21, 2019

(65) Prior Publication Data

US 2020/0231196 A1 Jul. 23, 2020

(30) Foreign Application Priority Data

Sep. 18, 2017 (DE) ..... 10 2017 008 702.4

(51) Int. Cl.
*B61L 27/00* (2022.01)
*B61L 27/50* (2022.01)
*B61L 27/40* (2022.01)

(52) U.S. Cl.
CPC ..... *B61L 27/50* (2022.01); *B61L 27/40* (2022.01)

(58) Field of Classification Search
CPC ..... B61L 27/50; B61L 27/40
See application file for complete search history.

(56) References Cited

U.S. PATENT DOCUMENTS

2016/0046307 A1* 2/2016 Miyajima ..... B61L 27/70 701/19
2017/0148323 A1 5/2017 Shubs, Jr.
(Continued)

FOREIGN PATENT DOCUMENTS

CN 102085814 A 6/2011
DE 602004000115 T2 7/2006
(Continued)

OTHER PUBLICATIONS

European Office Action issued in corresponding EP Application No. 18762007.5, dated Mar. 2, 2022, pp. 1-18, together with English translation.

*Primary Examiner* — Peter D Nolan
*Assistant Examiner* — Demetra R Smith-Stewart
(74) *Attorney, Agent, or Firm* — Carter, DeLuca & Farrell LLP

(57) ABSTRACT

In a rail system and method for operating a rail system having a rail-guided mobile part and having a central control system, the mobile part includes a device for acquiring the position of the mobile part, the mobile part has a first drive, in particular a traction drive, the mobile part has a current acquisition device, the mobile part has a processor for evaluating the current-value profile acquired between a first position and a second position, the processor as a device for evaluating the current-value profile is configured such that the processor determines as an evaluation value tuples which include at least an item of position information and a value
(Continued)

determined from the current-value profile, the processor is connected with the aid of a data transmission channel to the central control system for the transmission of the value tuples, the central control system is adapted to monitor the value tuples and monitors the respective value determined from the individual current profile for an exceeding of a permissible measure of a deviation from a predefined value, in particular a setpoint value.

15 Claims, 1 Drawing Sheet

(56) References Cited

U.S. PATENT DOCUMENTS

| | | | | |
|---|---|---|---|---|
| 2017/0151971 | A1* | 6/2017 | Shubs, Jr. | B61L 15/0027 |
| 2017/0178426 | A1* | 6/2017 | Ezawa | B61K 9/00 |

FOREIGN PATENT DOCUMENTS

| | | | | |
|---|---|---|---|---|
| DE | 102005045603 | A1 | 4/2007 | |
| EP | 0917979 | A1 | 5/1999 | |
| EP | 1900597 | A1 | 3/2008 | |
| EP | 2765053 | A2 | 8/2014 | |
| EP | 2064106 | B1 | 6/2016 | |
| EP | 2858937 | B1 | 10/2016 | |
| WO | 2013045242 | A2 | 4/2013 | |
| WO | WO-2013045242 | A2 * | 4/2013 | B60M 3/04 |

* cited by examiner

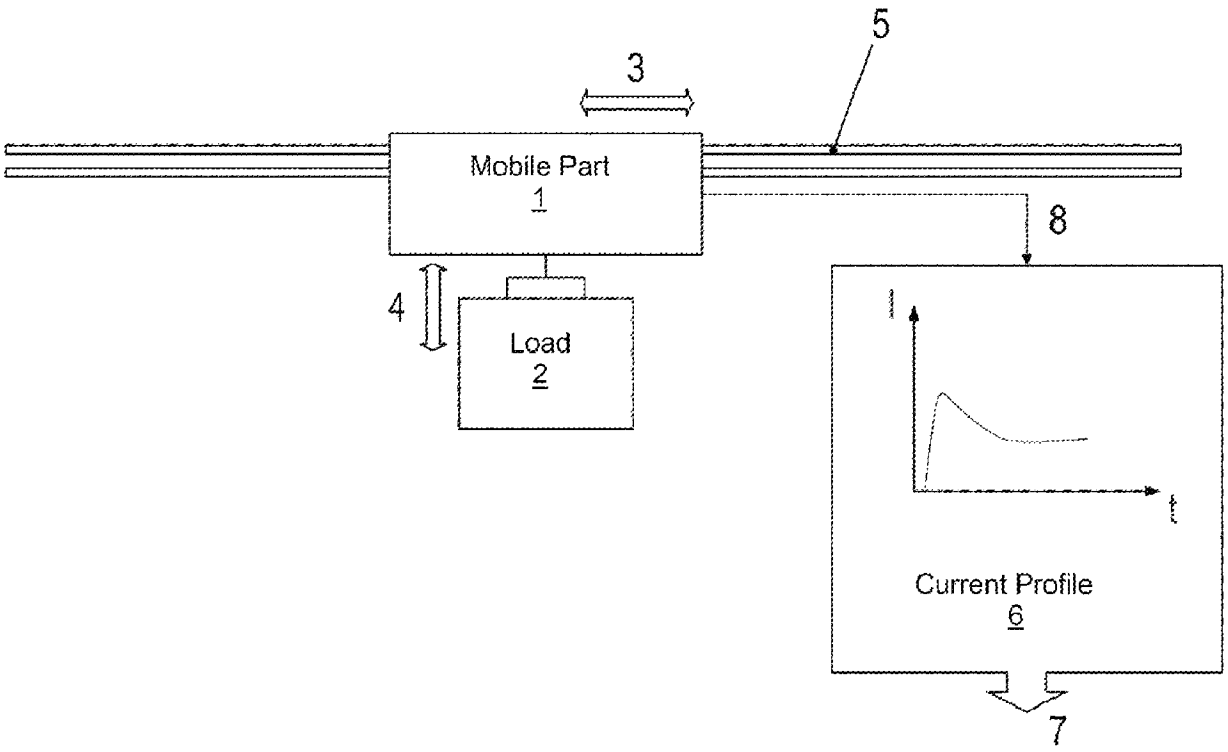
5
3
Mobile Part
1
Load
2
4
8
I
t
Current Profile
6
7

RAIL SYSTEM AND METHOD FOR OPERATING A RAIL SYSTEM HAVING A RAIL-GUIDED MOBILE PART AND HAVING A CENTRAL CONTROL SYSTEM

FIELD OF THE INVENTION

The present invention relates to a rail system and to a method for operating a rail system having a rail-guided mobile part and having a central control system.

BACKGROUND INFORMATION

It is generally conventional to acquire a current and to drive mobile parts with the aid of a first drive.

European Published Patent Application No. 2 765 053 describes a diagnostics system for a rail train.

A method for monitoring the state of railway vehicles is described in European Published Patent Application No. 0 917 979.

U.S. Patent Application Publication No. 2017/0178426 describes an abnormality diagnostics device.

German Published Patent Application No. 60 2004 000 115 describes a train control system.

German Published Patent Application No. 10 2005 045 603 describes a method for monitoring the interference behavior of a drive unit of a rail vehicle.

European Published Patent Application No. 2 858 937 describes a crane operating method.

SUMMARY

Example embodiments of the present invention provide for improving the safety in a rail system.

According to an example embodiment of the present invention, in a rail system having a rail-guided mobile part and having a central control system, the mobile part includes a device for acquiring the position of the mobile part. The mobile part has a first drive, in particular a traction drive, and the mobile part has a device for current acquisition. The mobile part has a processor for evaluating the current-value profile acquired between a first position and a second position, and the processor as a device for evaluating the current-value profile is configured such that the processor determines as an evaluation value tuples which include at least an item of position information and a value determined from the current-value profile. The processor is connected with the aid of a data transmission channel to the central control system for the transmission of the value tuples. The central control system is adapted to monitor the value tuples and the respective value determined from the individual current profile for an exceeding of a permissible measure of a deviation from a predefined value, in particular a setpoint value. The central control system displays an error state or a warning if the measure has been exceeded.

This has the advantage of greater safety. As soon as the measure has been exceeded, an error report is output and/or a warning is displayed or forwarded. The predefined value is either a correct value or a learned value, e.g., the average value of the values up to this point. As a result, a suddenly occurring error is able to be identified. The failure of a bearing, for example, is detectable or other events that increase the coefficient of friction. In this context, it is important that the current profile be acquired as a function of the position of the mobile part in the rail system. Thus, it is possible for the central control system to evaluate the values of all similar mobile parts that carry out the same orders and driving movements at this position or on this driving route in each case. For example, if a load is picked up ahead of the position and the mobile part then crosses the first position and proceeds to a second position, the load is raised further by the second drive during the driving operation. Thus, when the total current is acquired, it is possible to ascertain a value from the current profile that is able to be compared to a correct value and an error or a warning is reported if an impermissibly high deviation is determined.

According to example embodiments, the current acquisition device acquires the current drawn by the first drive, or the current acquisition device acquires the current drawn by the first and second drives or the current drawn by all electrical consumers of the mobile part, one of the consumers in particular being the first drive, and/or one of the consumers being the second drive. This is considered advantageous insofar as uncomplicated monitoring is able to be carried out.

According to example embodiments, the average value of the current-value profile is calculated as the value determined from the current-value profile and/or the maximum value and/or the minimum value of the current-value profile. This has the advantage that values that are easy to determine are used so that it is not necessary to transmit the entire current profile but only individual values to the central control system. In this manner, only a small bandwidth is required in the data transmission.

According to example embodiments, the value tuple also includes a minimum value and/or a maximum value of the current-value profile, and the central control system monitors the particular minimum value determined from the respective current profile for an exceeding of a permissible measure of a deviation from a second predefined value, in particular a setpoint value, and/or the central control system monitors the particular maximum value determined from the respective current profile for an exceeding of a permissible measure of a deviation from a third predefined value, in particular a setpoint value. This has the advantage that not only the average value but also additional values that are characteristic of the current profile are able to be transmitted.

According to example embodiments, the value tuple also includes a value that is related to the weight of a load picked up by the mobile part, and/or the value tuple includes a value that is determined from an acquired current profile of the second drive of the mobile part by which a load is able to be picked up, the central control system monitors a value determined from the further current profile for an exceeding of a permissible measure of a deviation from a predefined value, in particular a setpoint value. This is considered advantageous insofar as it is possible to monitor whether an error occurs at the second drive, e.g., a malfunction of a part of the second drive or an obstacle when lifting the load.

According to example embodiments, the central control system transmits position setpoint values to the mobile part via a data transmission channel, to which the mobile part is controlled with the aid of the first drive. This is considered advantageous insofar as only the value rather than the entire current profile has to be transmitted, and only a small bandwidth is required as a result.

According to example embodiments, the value tuple includes the acquired current-value profile, and the central control system monitors whether the current-value profile lies within a predefined band. This has the advantage that while a higher bandwidth may be required in the transmission, the entire current profile is able to be precisely monitored, that is to say, individual outliers are able to be identified.

According to an example embodiment of the present invention, in a for operating a rail system having a rail-guided mobile part and having a central control system, the position of the mobile part is detected, the mobile part has a first drive, in particular a traction drive, and the current drawn by the first drive or the current drawn by the entire mobile part is acquired, and the current-value profile acquired between a first position and a second position is evaluated in a processor of the mobile part in that value tuples are determined which include at least one item of position information and a value determined from the current-value profile in each case. The value tuples are transmitted from the mobile part to the central control system, and the central control system monitors the value determined from the individual current profile for an exceeding of a permissible measure of a deviation from a predefined value, in particular a setpoint value. The central control system particularly displays or reports an error state or a warning if the measure is exceeded.

This has the advantage of increased safety in that the current profile is monitored.

According to example embodiments, the average value is calculated as the value determined from the current-value profile, and/or the maximum value of the current-value profile and/or the minimum value of the current-value profile. This is considered advantageous insofar as a simple calculation is required.

According to example embodiments, the value tuple also includes a minimum value and/or a maximum value of the current-value profile, the central control system monitors the individual minimum value determined from the respective current profile for an exceeding of a permissible measure of a deviation from a second predefined value, in particular a setpoint value, and/or the central control system monitors the individual maximum value determined from the respective current profile for an exceeding of a permissible measure of a deviation from a third predefined value, in particular a setpoint value. This has the advantage that it is possible to use not only the average value but also additional values.

According to example embodiments, the value tuple also includes a value that is related to the weight of a load picked up by the mobile part, and/or the value tuple includes a value determined from an acquired current profile of the second drive of the mobile part by which a load is able to be picked up, and the central control system monitors a value determined from the further current profile for an exceeding of a permissible measure of a deviation from a predefined value, in particular a setpoint value. This has the advantage that an error in the second drive or during the lifting of the load is able to be detected.

According to example embodiments, the central control system transmits position setpoint values to the mobile part via the data transmission channel, to which the mobile part is controlled with the aid of the first drive. This has the advantage that the channel is able to be used in a bidirectional manner. As a result, the channel is able to be used for the control of the mobile parts for the safety-relevant information via the central control system.

According to example embodiments, the value tuple includes the acquired current-value profile, and the central control system monitors whether the current-value profile lies within a predefined band. This has the advantage that it allows for more precise monitoring, the data transmission channel having to provide a high bandwidth.

Further features and aspects of example embodiments of the present invention are described in greater detail below with reference to the appended FIGURE.

BRIEF DESCRIPTION OF THE DRAWING

In FIG. 1, a system according to an example embodiment of the present invention is schematically illustrated.

DETAILED DESCRIPTION

As illustrated in FIG. 1, the system has a mobile part 1, in particular a rail vehicle, and rails 5 on which mobile part 1 is able to be driven.

Mobile part 1 has a first drive, which drives mobile part 1 along rails 5. A second drive of mobile part 1 is used for lifting or lowering a load 2 that is picked up.

Mobile part 1 has a control, which is connected with the aid of a data transmission channel 8, in particular with the aid of a wireless data link, for a data exchange to a central control of the system, which in particular is fixedly connected to rails 5 or to a device that is fixedly connected to rails 5. The central control system thus is unable to move relative to rails 5.

Mobile part 1 has a current acquisition device, and the current drawn by the first drive is acquired. An exemplary current profile during an initial acceleration, i.e., an intermittent acceleration of mobile part 1 over time, is illustrated in FIG. 1, mobile part 1 continuing its travel at a constant speed following an acceleration period.

The acquisition of the current profile begins at a first position A of mobile part 1 and ends at a second position B.

The control includes a device for calculating the average value, the maximum value and the minimum value of the current profile.

The average value is transmitted to the central control system via data transmission channel 8. No large bandwidth is therefore required for data transmission channel 8.

In addition, setpoint values for the next position to be reached by mobile part 1 are transmitted via data transmission channel 8. Since the central control system transmits such updated target positions in a consecutive manner for over two hundred mobile parts 1, and each mobile part 1 transmits the respectively determined instantaneous average value and possibly further values, an Ethernet protocol is able to be used.

The central control system monitors the respective average value allocated to position A and B for an exceeding of a permissible measure of a deviation from a predefined value. As soon as an exceedance is detected, a warning is displayed or forwarded. As a result, a fault of the mobile part or the system is detectable.

The fault, for example, is a defective bearing, which leads to an increased torque of the first drive because the control of the mobile part is trying to reach the destination position.

In a further arrangement, the predefined value is a learned value such as the value averaged across all previously received average values.

Thus, only average values that are associated with the respective position A or the route from A to B are transmitted.

In further exemplary embodiments, the entire current consumption of mobile part 1 rather than the current profile of the first drive of mobile part 1 is used. Thus, it is then also possible to consider and monitor the picking up of a load, i.e. the raising or lowering of a load, with the aid of the current profile.

A fault, for example, is a malfunction in the second drive such as a defective bearing or the like, or an excessive load or stalling of the load on the stationary part of the system.

In further exemplary embodiments, a data transmission channel 8 offering a larger bandwidth is used. Instead of the average values, additional values that characterize the current profile are therefore transmittable to the central control system, in particular even the entire current profile.

Thus, it may then be monitored in the central control system whether the current profile lies within a band around a predefined current value characteristic. The band is characterized by a maximum value characteristic above the predefined current-value profile and by a minimum value characteristic below the predefined current-value profile. The width of the band, that is to say the difference between the maximum and the minimum values associated with the respective instant, is, for example, constant.

In further exemplary embodiments, the mobile part transmits the acquired current value for the individually acquired position to the central control system. As a result, this position-dependent value is able to be monitored for an impermissibly high deviation from a predefined value associated with the respective position.

LIST OF REFERENCE NUMERALS

1 mobile part, in particular rail vehicle
2 load
3 driving movement of mobile part 1
4 lifting or lowering of load 2
5 rail
6 current profile
7 processor-based analysis of the current profile
8 data transmission channel, in particular data radio connection

The invention claimed is:

1. A rail system, comprising:
a rail-guided mobile part including:
a position-acquisition device adapted to acquire a position of the mobile part;
a current-acquisition device;
a first drive;
a processor adapted to evaluate a current-value profile acquired between a first position and a second position by determination of value tuples as an evaluation, the value tuples including at least an item of position information and a value determined from the current-value profile; and
a central control system connected to the processor by a data transmission channel adapted to transmit the value tuples, the central control system adapted to monitor the value tuples and to monitor a respective value determined from an individual current profile for an exceeding of a permissible measure of a deviation from a predefined value and/or a setpoint value, the central control system being adapted to display an error state and/or a warning if the measure has been exceeded.

2. The rail system according to claim 1, wherein the first drive includes a traction drive.

3. The rail system according to claim 1, wherein the current-acquisition device is adapted to acquire current drawn by the first drive, to acquire current drawn by the first drive and a second drives, and/or current drawn by all electrical consumers of the mobile part.

4. The rail system according to claim 1, wherein an average value of the current-value profile is calculated as the value determined from the current-value profile, a maximum value, and/or a minimum value of the current-value profile.

5. The rail system according to claim 1, wherein the value tuple includes a minimum value and/or a maximum value of the current-value profile, the central control system adapted to monitor a particular minimum value determined from a respective current profile for an exceeding of a permissible measure of a deviation from a second predefined value and/or setpoint value, and/or the central control system is adapted to monitor a particular maximum value determined from a respective current profile for an exceeding of a permissible measure of a deviation from a third predefined value and/or setpoint value.

6. The rail system according to claim 1, wherein the value tuple includes a value that is related to a weight of a load picked up by the mobile part and/or a value that is determined from an acquired current profile of a second drive of the mobile part adapted to pick up a load, the central control system being adapted to monitor a value determined from a further current profile for an exceeding of a permissible measure of a deviation from a predefined value and/or a setpoint value.

7. The rail system according to claim 1, wherein the central control system is adapted to transmit position setpoint values to the mobile part via a data transmission channel, to which the mobile part is controlled with the aid of the first drive.

8. The rail system according to claim 1, wherein the value tuple includes the acquired current-value profile, and the central control system is adapted to monitor whether the current-value profile lies within a predefined band.

9. A method for operating a rail system that includes a rail-guided mobile part and a central control system, the mobile part including a first drive, comprising:
detecting a position of the mobile part;
acquiring a current drawn by the first drive or a current drawn by the entire mobile part;
evaluating a current-value profile acquired between a first position and a second position in a processor of the mobile part, including determining value tuples that include at least one item of position information and a value determined from the current-value profile;
transmitting the value tuples from the mobile part to the central control system;
monitoring, by the central control system, a value determined from an individual current profile for an exceeding of a permissible measure of a deviation from a predefined value and/or a setpoint value; and
displaying and/or reporting, by the central control system, an error state and/or a warning if the measure is exceeded.

10. The method according to claim 9, wherein the first drive includes a traction drive.

11. The method according to claim 9, wherein an average value, a maximum value, and/or a minimum value of the current-value profile is calculated as the value determined from the current-value profile.

12. The method according to claim 9, wherein the value tuple includes a minimum value and/or a maximum value of the current-value profile, the central control system monitors an individual minimum value determined from a respective current profile for an exceeding of a permissible measure of a deviation from a second predefined value and/or setpoint value, and/or the central control system monitors an individual maximum value determined from a respective current profile for an exceeding of a permissible measure of a deviation from a third predefined value and/or setpoint value.

13. The method according to claim 9, wherein the value tuple includes a value that is related to a weight of a load picked up by the mobile part and/or a value determined from an acquired current profile of a second drive of the mobile part adapted to pick up a load, the central control system monitoring a value determined from a further current profile for an exceeding of a permissible measure of a deviation from a predefined value and/or setpoint value.

14. The method according to claim 9, wherein the central control system sends position setpoint values to the mobile part via a data transmission channel, to which the mobile part is controlled with the aid of the first drive.

15. The method according to claim 9, wherein the value tuple includes the acquired current-value profile, and the central control system monitors whether the current-value profile lies within a predefined band.

* * * * *